United States Patent [19]

Schosek

[11] 4,247,081

[45] Jan. 27, 1981

[54] FRONT MOUNTED BRACE FOR AN UNDERGROUND PIPE INSTALLING DEVICE

[76] Inventor: William O. Schosek, 7942 Marx Dr., North Fort Myers, Fla. 33903

[21] Appl. No.: 68,152

[22] Filed: Aug. 20, 1979

[51] Int. Cl.[3] ..... E21B 19/00
[52] U.S. Cl. ..... 254/29 R
[58] Field of Search ..... 254/29 R

[56] References Cited

U.S. PATENT DOCUMENTS 4,000,879 1/1977 Martin et al. ..... 254/29 R

*Primary Examiner*—Robert C. Watson
*Attorney, Agent, or Firm*—Alfred E. Wilson

[57] ABSTRACT

A front mounted brace for an underground pipe installer device comprised of a vertically disposed abutment frame, transversely pivotally mounted to a front end portion of an underground pipe installer device, the frame being comprised of upper and lower rails, interconnected by a plurality of vertical struts. Upper and lower front end extensions from the pipe installer pivotally carry the frame.

5 Claims, 3 Drawing Figures

FRONT MOUNTED BRACE FOR AN UNDERGROUND PIPE INSTALLING DEVICE

BACKGROUND OF THE PRESENT INVENTION

It is frequently necessary to install an underground pipe between two given points on opposed sides of a finished street or driveway, for example. It is routine procedure to provide an operating trench on one side and a target trench on the opposite side. An underground pipe installer device is properly positioned and braced for operation in the operating trench.

A first rod length is manually inserted through drive jaw means of the installer device and is engaged thereby to push the first rod length toward the target trench, generally by a fluid operated cylinder and piston assembly. The trailing end of the first rod length is provided with a coupling to receive a second rod length and the drive means is actuated to push the second rod length forwardly toward the target trench. A sufficient plurality of connected rod lengths are driven forwardly until the leading tip end of the first rod length emerges into the target trench.

The leading tip end is threadedly provided with a pusher cap which is removed and replaced with an adapter for attachment to an end of a pipe to be permanently installed under the above surface. For this purpose, means are provided to reverse the direction of movement of the rod assembly to pull the pipe attached thereto backwardly through the hole, formed by the rod assembly, until the leading end of the pipe emerges into the operating trench.

The above described operations are quite conventional, however, it is essential to anchor the pipe installer device in the operating trench against the very substantial reaction forces of the rod pushing operation so as to maintain sufficient space behind the pipe installer device to accomplish the manual rod coupling and uncoupling operations which are essential in forming the hole and in withdrawing the pipe into the hole.

Heretofore, all underground pipe installer devices have been braced against the rear end vertical face of the operating trench during the rod pushing operation, and the bracing structure was then removed and engaged against the front end vertical face of the operating trench for the pipe pulling operation. Examples of such brace means are illustrated in Applicants U.S. Pat. Nos. 3,907,253, 3,988,003 and 3,988,004.

The front mounted brace means of the present invention is comprised of a generally rectangular abutment frame, formed of top and bottom rails, interconnected by vertical struts. The frame is vertically, transversely, centrally pivotally attached between upper and lower front end extensions from the device. A generally T-shaped trench is provided for the device with the main length thereof being positioned in the longitudinal portion of the T-trench with the transverse frame being positioned in the cross portion of the T-trench. The pipe installer device is thereby braced for both the rod pushing and the pipe pulling operations.

Therefore, one of the principal objects of the present invention is to provide a front mounted means for an underground pipe installer device to brace the device against the reaction forces of both a rod pushing hole forming operation, and a pipe pulling operation for installing the pipe in the formed hole.

Another object of the present invention is to provide a transverse vertically disposed abutment frame, centrally pivotally attached between upper and lower front end extensions of a main longitudinal length of an underground pipe installer device.

A further object of the invention is to provide an abutment frame comprised of upper and lower beams connected by a plurality of rigid vertical struts.

DESCRIPTION OF A PREFERRED EMBODIMENT

Figure 1:
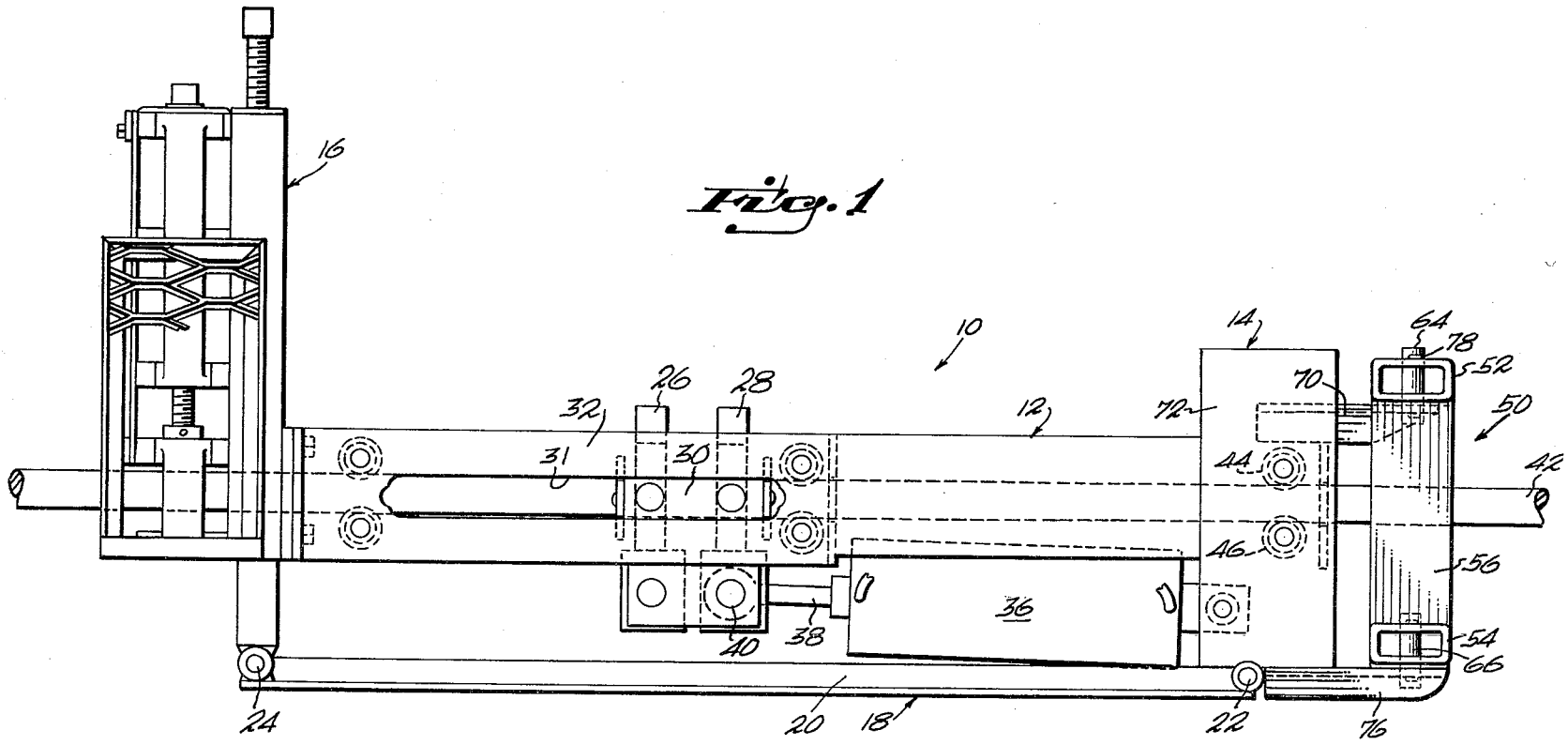
FIG. 1 is a side elevational view of an underground pipe installer device incorporating the front, pivotally mounted brace means of the present invention.
Figure 2:
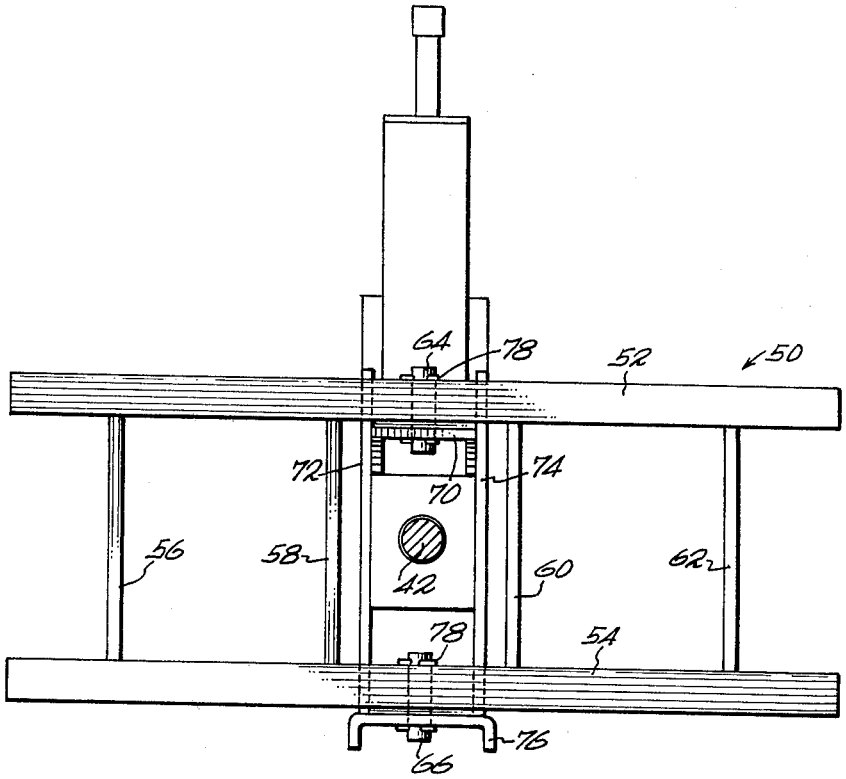
FIG. 2 is a front elevational view of FIG. 1.

With reference to the drawings in which like reference characters designate like or corresponding parts throughout the several views, and with particular reference to FIG. 1, an underground pipe installer device, designated generally at 10, includes a main central length 12 connecting between front and rear end portions 14, 16, mounted to a base 18 including a main central length 20, connected at 22, 24 between front and rear end portions 14, 16.

Figure 3:
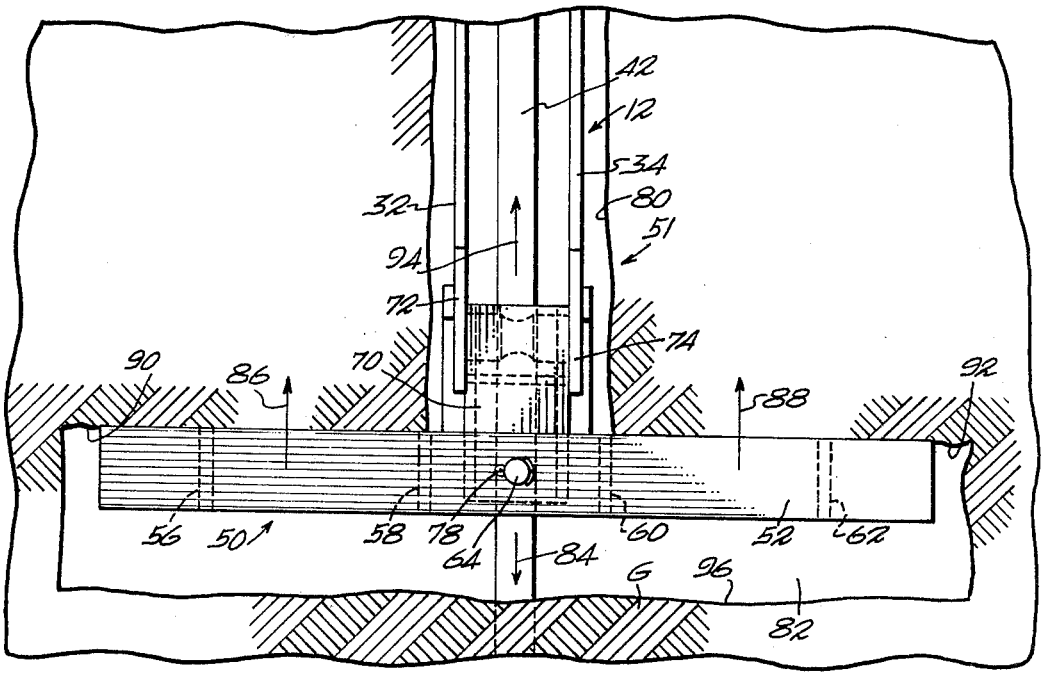
FIG. 3 is a fragmentary top plan view thereof, positioned in a T-trench.

A pair of reversible drive jaws 26, 28 are slidably journaled as at 30 in slots 31 in respective side walls 32, 34 of said central length 20, FIGS. 1 and 3, and a fluid operated cylinder and piston assembly 36, 38 are operably connected at 40 to jaws 26, 28 to provide a reciprocating drive movement to a push rod assembly 42, comprised of a coupled plurality of rod lengths, engaged in jaws 26, 28 in a manner whereby the rod assembly 42, first may be driven forwardly through the ground to form a hole between operating and target trenches, and second, the jaws are then reversed to pull a pipe backwardly through the hole into an installed position. The push rod 42 is guided and controlled along the length of the device 10 by a plurality of pairs of guide rollers such as 44, 46. The above described operations are, in general, conventional and the mechanisms to perform said operations form no part of the present invention.

A front mounted brace, indicated generally at 50, is provided to secure the device in position, during operation, in a generally T-shaped trench 51, FIG. 3, in a manner to be subsequently described.

The brace 50 is comprised of a generally rectangular abutment frame including top and bottom beams 52, 54, interconnected by a plurality of vertical struts, four illustrated at 56, 58, 60 and 62. The top and bottom beams 52, 54 and struts 56 and 62 are rigidly fixed in assembly, as by welding. Top and bottom axially aligned pivot means, such as pins 64, 66, engage respectively through the top and bottom beams 52, 54 centrally of their lengths. Top pviot pin 64 engages through a forward extended end portion of a bracket 70, fixed as by welding in a generally horizontal attitude between top portions of a pair of spaced apart plates 72, 74 comprising said front end portion 14. Bottom pivot pin 66 engages through a forward extended end of a forward base portion 76, fixed as by welding to bottom ends of plates 72, 74. Pivot pins 64, 66 are secured in place by any conventional type of securing means, such as 78.

As illustrated in FIG. 3, the main central length 12 of the device is disposed in the longitudinal portion 80 of T-trench 51, with the abutment frame 50 transversely disposed in the transverse trench portion 82. When forwardly directed forces are applied to the rod 42 to drive it into the ground G as indicated by arrow 84, the reaction forces indicated by arrows 86, 88 are absorbed by the back vertical walls 90, 92 of the transverse trench portion 82. It should be noted that the basic reaction forces are transmitted axially rearwardly through the rod assembly 42, indicated by arrow 94, and said reaction forces are transmitted through the drive jaws 26, 28, cylinder and piston assembly 36, 38, and main central length 20 to the pivotally mounted abutment frame 50, which will pivot to accommodate any angular deviation of trench portion 82 from a true ninety degrees relative to trench portion 80. In other words, the trench need not be accurately formed as the brace frame 50 is free to pivot into a solid engagement with vertical wall portions 90 and 92.

When the drive jaws 26, 28 are reversed, to pull a pipe into the formed hole, the reaction forces will be reversed and will be directed as indicated by arrow 84 and the reverse rod movement will be in the direction of arrow 94. The installer device 10 will, therefore, move forwardly until the abutment frame 50 seats against the forward vertical wall 96. It should be noted that the width of the transverse trench portion 82 is somewhat exaggerated in the drawings for illustrative purposes. In practive, the width need only be sufficient to freely accommodate the brace frame 50, and the movements of the device 10 in response to the reaction forces of forward and reverse operations of drive jaws 26, 28 are very minimal.

I claim:

1. A brace structure for attachment to the front end portion of an underground pipe installer device of a type including reversible power operated means to drive a rod assembly through the ground from a longitudinal operating trench portion for penetration into a target trench, in a forward drive position, and to withdraw the rod assembly, in a reverse drive position, with a pipe or other conduit, attached to a leading rod end, into an installed position through the hole in the ground, formed by the rod assembly, the brace structure comprising, abutment means for disposition in a generally transverse operating trench portion formed across a front end of the longitudinal operating trench portion in a manner so as to define a generally T shaped trench, said abutment means being of a predetermined enlarged size so as to define a substantial area of contact with a rear generally vertical wall of the transverse operating trench portion in response to reaction forces, with the power operated means in said forward drive position, and a substantial area of contact with a forward vertical wall of the transverse operating trench portion in response to reaction forces with the power operated means in said reverse drive position; and means to centrally vertically pivotally attach said abutment means to said front end portion.

2. The brace structure as defined in claim 1 wherein said abutment means comprises a generally rectangular frame structure providing front and rear wall portions lying respectively in front and rear generally parallel planes.

3. The brace structure as defined in claim 2 wherein said frame structure is formed of a plurality of generally horizontally extending spaced apart beams, integrally connected by a plurality of strut members.

4. The brace structure as defined in claim 3 wherein said plurality of spaced apart beams comprises a top beam and a bottom beam interconnected by at least one of said strut members on each side of said pivotal attachment.

5. The brace structure as defined in claim 4 including top and bottom means projecting in a fixed relation from a front end of the pipe installer device, respectively above and beneath a path of travel of the rod assembly; and top and bottom pivot pins, comprising said means to pivotally attach, engaged respectively through said top projecting means and top beam, and said bottom projecting means and bottom beam.

* * * * *